US008277201B2

(12) United States Patent
Krohn

(10) Patent No.: US 8,277,201 B2
(45) Date of Patent: Oct. 2, 2012

(54) PUMP APPARATUS

(75) Inventor: Mark Krohn, Caboolture (AU)

(73) Assignee: Halliburton Energy Services Inc., Duncan, OK (US)

( * ) Notice: Subject to any disclaimer, the term of this patent is extended or adjusted under 35 U.S.C. 154(b) by 269 days.

(21) Appl. No.: 12/671,099

(22) PCT Filed: Aug. 8, 2007

(86) PCT No.: PCT/AU2007/001107

§ 371 (c)(1),
(2), (4) Date: Mar. 10, 2010

(87) PCT Pub. No.: WO2009/018599

PCT Pub. Date: Feb. 12, 2009

(65) Prior Publication Data

US 2010/0196169 A1 Aug. 5, 2010

(51) Int. Cl.
*F04B 23/04* (2006.01)

(52) U.S. Cl. ..... 417/122; 417/86; 417/87; 417/123; 417/137; 417/144

(58) Field of Classification Search ..... 417/86, 417/87, 122, 123, 125, 137, 144
See application file for complete search history.

(56) References Cited

U.S. PATENT DOCUMENTS 3,861,830 A * 1/1975 Johnson ..... 417/149
4,278,367 A * 7/1981 Jacobson ..... 406/109
4,420,279 A * 12/1983 Easley, Jr. ..... 406/14
(Continued)

FOREIGN PATENT DOCUMENTS

JP 08159037 6/1996
(Continued)

OTHER PUBLICATIONS

Foreign communication from a related counterpart application—International Preliminary Report on Patentability, PCT/AU2007/001107, Feb. 9, 2010, 4 pages.

(Continued)

*Primary Examiner* — Devon Kramer
*Assistant Examiner* — Dominick L Plakkoottam
(74) *Attorney, Agent, or Firm* — John W. Wustenberg; Conley Rose, P.C.

(57) ABSTRACT

Vessels (10, 11, 12 and 13) are associated with an inlet manifold (14) passing to inlets (16), each controlled by a knifegate valve (17). The lower ends of the pots (10) and (12), and pots (11) and (13), pass material through respective outlet knifegate valves (22) to respective first (23) and second (24) delivery lines. The respective knifegate valves (17) and outlet knifegate valves (22) of pots (10) and (11) on the one hand and pots (12) and (13) on the other, are operable by respective common pneumatic actuators (25). Each pot has an ejector assembly (26) having an upper chamber (28), an air injector nozzle (30), and an accelerator tube (31) to create the venturi function. An air cycling valve (32) transitions the upper chamber (28) between a depressurized space and a pressurized space. The accelerator tube (31) exhausts to a delivery line (23 or 24). Ejector assembly (26) air is supplied via air control valve (35). The respective delivery lines (23) and (24) each have an eductor port (37) which allow for air to be ported into the line. The completed load and discharge cycle is governed by a pneumatic PLC and pneumatic timers.

26 Claims, 2 Drawing Sheets

U.S. PATENT DOCUMENTS

| | | | | | |
|---|---|---|---|---|---|
| 4,545,410 | A | * | 10/1985 | Paul et al. | 141/18 |
| 5,513,682 | A | * | 5/1996 | Derby | 141/67 |
| 5,531,252 | A | * | 7/1996 | Derby et al. | 141/67 |
| 5,938,408 | A | | 8/1999 | Krichbaum | |
| 6,224,345 | B1 | | 5/2001 | Dussault | |
| 6,234,762 | B1 | | 5/2001 | Lucas | |
| 2004/0055316 | A1 | * | 3/2004 | Emmer et al. | 62/50.6 |

FOREIGN PATENT DOCUMENTS

| | | | | |
|---|---|---|---|---|
| SU | 1536079 | A1 | | 1/1990 |
| SU | 1596079 | A1 | | 9/1990 |
| WO | 2006037186 | A1 | | 4/2006 |
| WO | WO 2006037186 | A1 | * | 4/2006 |
| WO | 2009018599 | A1 | | 2/2009 |

OTHER PUBLICATIONS

Foreign communication from a related counterpart application—International Search Report and Written Opinion, PCT/AU2007/001107, Oct. 29, 2007, 6 pages.

* cited by examiner

PUMP APPARATUS

CROSS-REFERENCE TO RELATED APPLICATIONS

This application is a filing under 35 U.S.C. 371 of International Application No. PCT/AU2007/001107, filed Aug. 8, 2007 and entitled "Pump Apparatus," which application is incorporated by reference herein in its entirety.

FIELD OF THE INVENTION

This invention relates to pump apparatus.

This invention has particular but not exclusive application to pump apparatus for pumping wet slurries of particulates, and for illustrative purposes reference will be made to such application. However, it is to be understood that this invention could be used in other applications, such as the pumping of liquids and wet or dry entrainable particulates generally, such as transporting wet, damp or dry solids, muddy products, slurries and liquids and grains.

BACKGROUND OF THE INVENTION

The reference to any prior art in this specification is not, and should not be taken as, an acknowledgement or any form of suggestion that the referenced prior art forms part of the common general knowledge in Australia.

PRIOR ART

Drilling for exploration and recovery is often done using drilling fluids to entrain the drill chips. Drill chippings may be screened out of the fluids either to recover the fluids for recycling for their own value or to simply maintain water balance. In either case there remain the drill chippings that form a slurry or wet gravel of chippings of varying fluidity. These chippings need to be moved about. The chippings form a mass that is invariably highly abrasive, and often either or both hot and chemically reactive.

Belt and auger conveyors are not constraining of the material and/or have a high maintenance requirement. Impeller pumps of are less than suitable due to the impeller coming into contact with the abrasive mixtures.

WO/2006/037186 describes pump apparatus including a housing having a material inlet for a material to be pumped and a delivery outlet, a valve on each of the inlet and outlet, and control means for selectively opening and closing the respective valves and cycle the pressure in the housing. When the pressure is low in the housing while the inlet valve is open, material is admitted to housing. When the control means effects closure of the inlet valve, the housing is pressurized and the outlet valve is open to discharge said material from said housing. The pressure cycling is achieved with compressed air and a venturi. This apparatus can be entirely pneumatic in operation, avoiding reliance on electronics for its fundamental operation.

The control means is all pneumatic and operates an ejector assembly which comprises the venturi adapted to cyclically reduce the housing pressure. The venturi waste air vents into the delivery line downstream of the outlet valve to provide additional delivery impetus. The compressed air supply to the ejector body is valved under control to switch from applying vacuum to the housing for the inlet phase of the cycle to supplying pressure to housing for the discharge phase.

It is a feature of drilling operations, and particularly of offshore drilling operations, is that there is effectively no process storage capacity. The volumes shifted are relatively large and variable. While the above apparatus is controllable over a narrow range of throughputs by control of cycle times and source air pressure, a single apparatus cannot be expected to deal with a wide range of throughputs. The technical solution applied is to mount as many apparatus of "pots" as the maximum expected throughput demands. In order to eliminate expert management of throughput, the pots are generally set to operate at optimum, irrespective of actual demand.

This approach has several disadvantages. The size of air plant required to run the multiple pots all of the time increases the footprint and especially the energy requirement. The lack of true integration does not allow an operator flexible control over both the throughput and the energy expended to transfer drill cuttings within a containment system as a variable drill program requires. The dynamics of simple of pairing of pots results in one system inevitably slaving to the other, reducing line velocities.

Accordingly, there is a need for a pumping arrangement that can cope with a variation of demand while maintaining reasonable energy consumption.

SUMMARY OF THE INVENTION

In one aspect the present invention resides broadly in pump apparatus including at least one group of pumping elements, each pumping element comprising a housing having a material inlet, a discharge outlet to a respective delivery line, and control means controlling actuators operating a valve on each of the material inlet and discharge outlet, a compressed air supply delivering cyclically to a venturi to reduce the housing pressure for charging and to the housing for pressure discharge, the venturi working air venting into the delivery line downstream of its closed outlet valve, the control means being operable to select which pumping elements are in use and the relative cycle phase of each pumping element in use.

Having the venturi working air discharge into the delivery line during the vacuum drawdown of the housing has several advantages. The venturi is effectively muffled, reducing the operating noise significantly. As the mass transfer effect of the pressure discharge causes a large reduction in pressure in the delivery line after outlet valve closure, there is little or no stalling of the venturi by back pressure. In the multiple-element apparatus of the present invention, the ability to exhaust the venturi to the discharge line is preserved by using different discharge lines for each member of the group, enabling the members of the group to be operated out of phase.

The group of pumping elements may include one pot per delivery line or may include multiple pots per delivery line. There may be provided multiple pumping elements which selectively deliver in phase to a delivery line so as to provide scalability of throughput on that particular delivery line. The delivery line may be provided with air injection means to supplement the pressure discharge. For example, after pressure discharge and closing of the outlet valve, high pressure air may be directed into the delivery line to add impetus to the material in the line. Thereafter, the additional air is shut off and the line pressure allowed to drop before the venturi is valved on and exhausted to the delivery line.

The inlets of the pumping elements may be manifolded together to draw from a common hopper or other material supply. The manifold may be in the form of a chamber that will be in a substantially constant state of reduced pressure by virtue of the out-of-phase operation of the group. The manifold may be associated with a storage means for accumulating product prior to pumping. The system is capable of drawing a head of product. However it is preferred that the material be delivered from a hopper in order to provide some gravity-assist and to minimize the mean free path for air through the product, thus maximizing the vacuum efficiency.

The housing or pot may be any suitable pressure vessel. The housings are preferably oriented with the inlets in the top and the delivery outlet at the bottom to provide gravity assistance to charge and discharge. This vertical orientation, coupled with a choice of shape and dimensions, may assist in optimizing throughput for a given footprint. The pressure vessel comprising the housing may be optimized for pressure keeping for a given wall thickness. For example the housing may be cylindrical with part-spherical or other rounded ends to resist pressure deformation. The lower end of the housing may include an inverted cone with the outlet at the apex to optimize gravity assistance in discharge through the outlet. The pressure vessel may be optimized for pressure keeping and have an internal cone fitted for optimizing flow.

The vessel orientation being vertical also allows for a much wider range in the moisture content of any material being recovered and transferred.

The inlet and outlet valves may each comprise a knifegate-type valve. The actuators for the valves are preferably pneumatic in operation. The inlet and outlet valves of a particular pumping element may be operationally interconnected to effect the cyclic operation of the respective valves for the charge and discharge of the pot. The operational interconnection may be mechanical, such as by means of a common double-action actuator.

Alternatively, the respective pairs of material inlet and discharge valves of adjacent pumping elements may be operationally interconnected for alternate operation to effect a lock-stepping of out-of-phase operation of the respective pots. The operational interconnection may be mechanical, such as by means of respective common double-action actuators.

The compressed air driven venturi may form part of an ejector assembly. The ejector assembly may include an elongate body including a low-restriction upper chamber narrowing to an accelerator tube. The venturi effect may be provided by an injector nozzle directing high pressure air from the air supply across the upper chamber into the accelerator tube, lowering the pressure in the upper chamber. The upper chamber may be in fluid communication with the top portion of the housing to effect a reduction in pressure in the housing. The air supply to the injector nozzle may be switched by an air control valve. The air control valve may be open through both the charge and discharge parts of the cycle, and may be closed to disable the pumping element when it is not required.

The injector nozzles and accelerator tubes (or diffusers) may be one or more of variable and interchangeable. By this means the configuration may be matched to the available air, so the unit can be arranged to maintain the same level of vacuum with more or less air. The volume of "entrapped air" may also be varied. A larger nozzle and its corresponding accelerator tube may create higher in-line velocities. Alternatively, a selected vacuum may be matched to a particular application, such as maintaining 25"Hg vacuum throughout a range of operation.

The change over from the air supply generating vacuum to the air supply pressurizing the housing may be by any suitable switching means. For example, there my be provided a selectable diverter upstream of the venturi and adapted to alternately switch the air supply between the venturi and a pressurizing inlet to the housing. Alternatively, the preferred ejector assembly may include a cycling valve across the accelerator tube or venturi exhaust and operable to alternately open and occlude the venturi exhaust path. An open cycling valve closure allows the venturi to operate and reduce pressure in the housing. A closed cycling valve stalls the venturi, closes off the venturi exhaust path to the delivery line, and pressurizes the upper chamber and housing.

The effect is that while the air control valve is open, and both the inlet and cycling valve are open and the outlet valve closed, material is charged into the housing under vacuum. By the simple expedient of closing the inlet valve, opening the outlet valve and switching the cycling valve to closed, the venturi is stalled and the housing pressurized to expel the housing contents at velocity into the delivery line.

While the outlet valve is closed for developing the charge vacuum, the venturi working air exhausts into the delivery line downstream of the closed outlet valve. It is highly desirable that the pots operating on a given delivery line are substantially synchronous. In order to obtain constant draw and enable operation at average air consumption instead of a peak, it is preferred that pots on separate delivery lines are operated evenly out of phase. In the case of systems having two delivery lines, pneumatic, hydraulic or mechanical linking of the inlet valves of pots on alternate delivery lines may ensure that when one is open the other is closed, and likewise for the outlet valves. Limit switches associated with the inlet and/or outlet valves may be used to ensure that the valves are appropriately set before the control means operates the cycling valve.

The control means may comprise one or more integrated or independent controllers controlling a hierarchy of functions. The control means may include one or more of electronic and pneumatic controllers. The controller may comprise a programmable logic controller (PLC). The PLC may be a 100% pneumatic PLC to avoid electronics. The control means may control directly or indirectly any one or more of the functions of charge volume control, discharge volume control, pot on/off control, air pressure regulation, inlet and outlet valve timing, venturi operation and housing pressurization control.

The controller may control the respective element operating phase by any suitable means. While out of phase locking by interconnection of inlet valves and interconnection of outlet valves is described above, it follows that phase control will require a different approach where the respective valves are not so linked. For example, the inlet and outlet valves of each pot may be interconnected for operation by a double acting pneumatic actuator and each actuator may be under the operational control of an air distributor function of the control means which ensures that the phase is controlled.

The controller may tap air from the air supply to power pneumatic timers for process timing control. For example a pneumatic timer may control an actuator or air solenoid to direct air to the preferred knifegate valve actuator and an actuator for the preferred valve changing the venturi from its vessel evacuating mode to its vessel-pressurizing mode. The preferred pneumatic PLC may include integrated timer functions, or may control external timers. The air control valve controlling the supply of air to the apparatus may be subject to switch means associated with the knifegate valve so the knifegate valves must be full open or closed before the air does its work either drawing vacuum or pressurizing the housing. While the timers control the timing, the switch means ensure that a respective knifegate is fully made one way or the other prior to allowing air through the system.

The control means may control the amount of material admitted to the housing for each cycle by any suitable means. For example the controller may include a timer function and the charge may be determined on an empirically determined time basis having regard to the nature of the material. Alternatively, the charge may be metered by weight, where a transducer or the like cooperates with the control means, or by volume, such as by a paddlewheel in the inlet supply.

In a further aspect the invention resides broadly in a scalable-output pump pack including an inlet manifold accepting material at a variable rate, at least one group of pumping elements each comprising a housing having a material inlet drawing from said manifold, a discharge outlet to a respective delivery line, and pneumatic control means controlling actuators operating a valve on each of the material inlet and discharge outlet, a compressed air supply delivering cyclically to a venturi to reduce the housing pressure for charging and to the housing for pressure discharge, the venturi working air venting into the delivery line downstream of its closed outlet valve, the control means being operable on the air supply to select which pumping elements are in use, and being operable to control said cyclic delivery and actuators to operate pumping elements discharging to a delivery line in phase, and to operate pumping elements discharging to different delivery lines out of phase.

BRIEF DESCRIPTION OF THE DRAWINGS

The invention will be described with reference to the following non-limiting embodiment of the invention as illustrated in the drawings and wherein.

Figure 1:
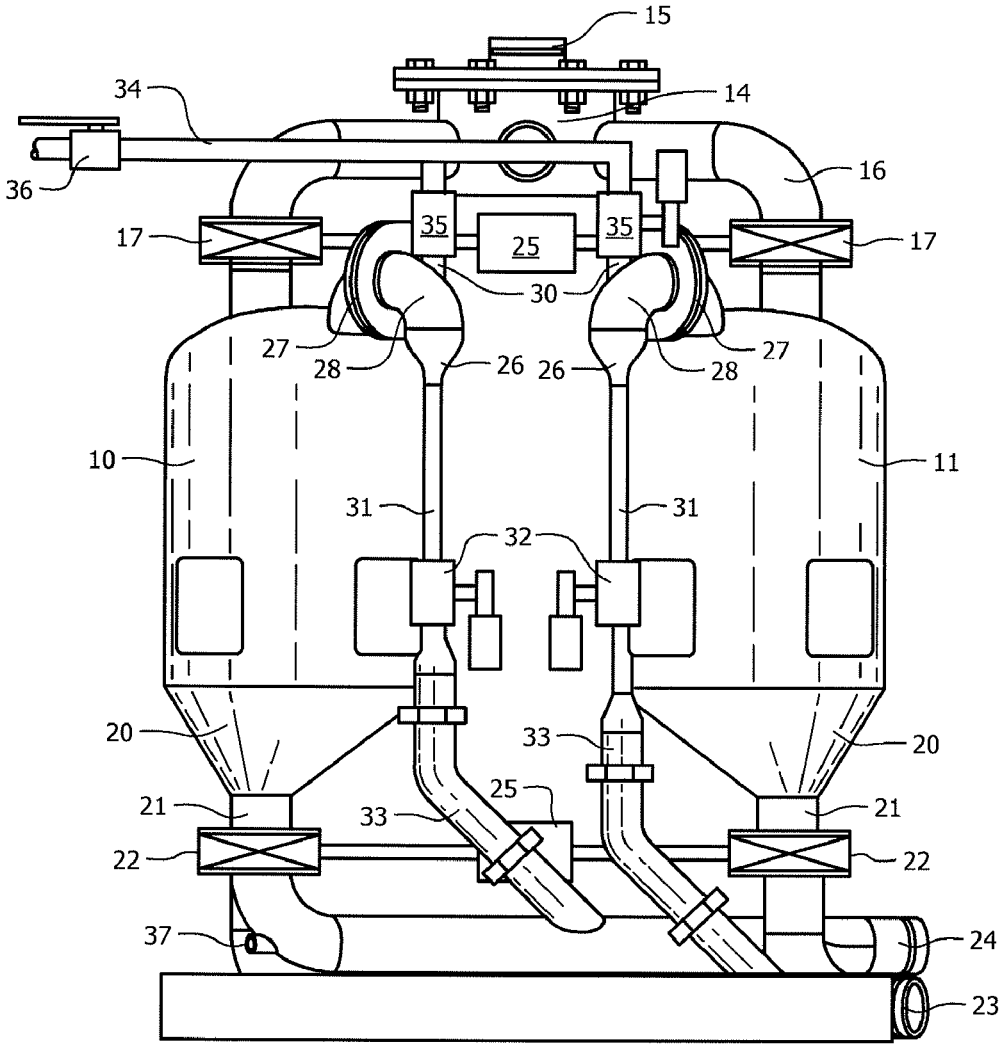
FIG. 1 is plan view of apparatus in accordance with the present invention.
Figure 2:
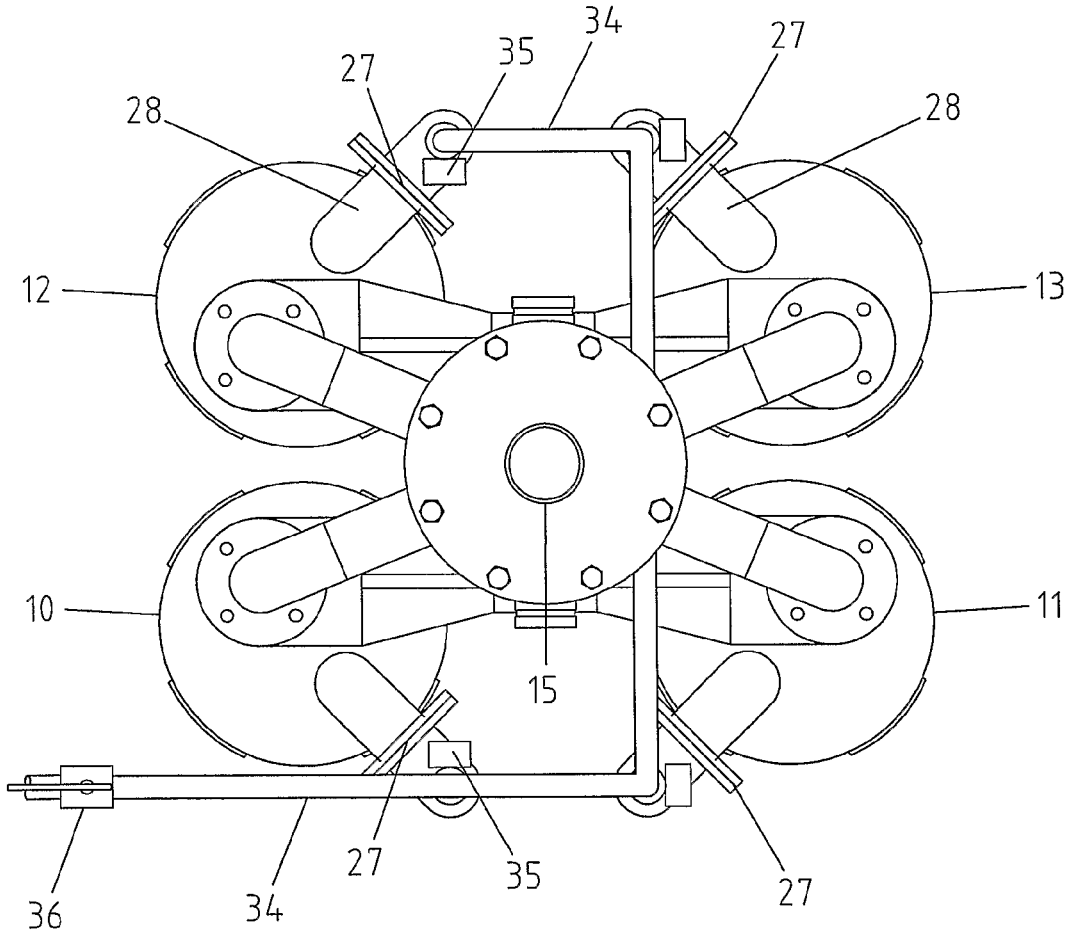
FIG. 2 is an elevation of the apparatus of FIG. 1.

In the figures there is provided a pump apparatus adapted to be pallet-mounted and comprising four pressure vessels (10, 11, 12 and 13) or pots, arranged on a square footprint. An inlet manifold (14) is supported above the pots and passes material from a central 200 mm top flanged access port (15) to respective 80 mm pot inlets (16), each controlled by an inlet knifegate valve (17). The lower end of the pressure vessels (10, 11, 12 and 13) are each provided with an inverted conical-wall collector (20) passing material into an outlet (21) controlled by an outlet knifegate valve (22). The outlets (21) of pots (10) and (12) pass into a first delivery line (23). The outlets (21) of pots (11) and (13) pass into a second delivery line (24).

The inlet knifegate valves (17) of pots (10) and (11) are interconnected and operable by a common, double acting pneumatic actuator (25). The outlet knifegate valves (22) of pots (10) and (11) are also interconnected and operable by a common, double acting pneumatic actuator (25). Similarly the inlet knifegate valves (17) of pots (12) and (13) are interconnected and operable by a common, double acting pneumatic actuator (25). The outlet knifegate valves (22) of pots (12) and (13) are also interconnected and operable by a common, double acting pneumatic actuator (25).

Each pot (10, 11, 12 and 13) has an ejector assembly (26) bolted up to a flanged opening (27) in the top of the pot. The ejector assembly (26) has an upper chamber (28) forming a downward-turn conduit from the flanged opening (27). An air injector nozzle (30) is directed downward through the sidewall of the upper chamber (28). The lower end of the upper chamber (28) transitions to a relatively narrow accelerator tube (31) aligned with the air injector nozzle (30) to create the venturi function. An air cycling valve (32) is interposed in the accelerator tube (31) to transition the upper chamber (28) between a depressurized space and a pressurized space. The accelerator tube (31) exhausts to an expansion conduit (33) which in turn dumps to its respective delivery line (23 or 24).

The air injector nozzle (30) of each ejector assembly (26) is supplied by air from a compressed air supply line (34) via a respective air control valve (35). The air control valve (35) comprises the on-off switch for taking its respective pot off-line. The compressed air supply line (34) includes a manual shut off ball valve (36) enabling the whole apparatus to be shut down at a single point.

Compressed air is supplied to the compressed air supply line (34) which inturn supplies air to the air control valves (35) and pneumatic control and circuitry located within an enclosure. If pressure vessels (10) and (12) are assumed to be in the vacuum part of the operating phase, the inlet knifegate valves (17) are ported open to the inlet manifold (14) whilst pressure vessels (11) and (13) and remain isolated from the inlet manifold (14) via their corresponding inlet knifegate valves (17). With all four air control valves (35) selected ON, air is ported via flexible manifold lines to each air injector nozzle (30). As pressure vessels (10) and (12) are in vacuum mode, their respective air cycling valves (32) are open allowing air to pass through the air injector nozzle (30) down the accelerator tube (31) thus generating and drawing a vacuum on pressure vessels (10) and (12), equalized at the inlet manifold (14). Exhaust air from the accelerator tube (31) is allowed to expand into the expansion conduit (33) and then directed into the first delivery line (23).

Correspondingly air directed to pressure vessels (11) and (13) via compressed air supply line (34) and air control valves (35) travels through the upper chamber (28) from the air injector nozzle (30) in each case, but is halted at air cycling valves (32) and thus redirected back into the pressure vessels (11) and (13), exerting pressure on, and expelling the contents. The contents are discharged through the second delivery line (24).

The respective delivery lines (23) and (24) each have a small solenoid controlled eductor port (37) which allow for air to be ported into the line to aerate the product and boost the in-line conveyor speed if required. The eductor ports (37) are controlled via separate switches within the control enclosure. The completed load and discharge cycle is governed by pneumatic timers which allow for variable cycle lengths depending on the materials viscosity.

It is to be understood that pots (10) and (11) on the one hand and pots (12) and (13) on the other hand, work in tandem. That is, with pot (10) and pot (12) having their knifegate valves (17, 22) in the discharge part of the cycle, pots (11) and (13) are in the load part of the cycle.

When compressed air is supplied to the compressed air supply line (34), any individual air control valve (35) can be enabled. Air is also ported to energise the control system including control solenoids. In normal operation with air control valve (35) to pot (10) selected to the open position, the air travelling through the upper chamber (28) to pressurize the pot (10) also passes through a discharge timer, activating it in the process. The air then actuates a control solenoid which ports air to the closed side of the inlet knifegate valve (17) relative to pot (10) and the open side of the outlet knifegate valve (22) along with actuating air cycling valve (32) closed. Air is tapped off the main manifold to supply pneumatic timers which control the main solenoid which in turn directs air to both the knifegate (17) and air cycling (32) valve actuators.

The air control valve (35) that controls the supply to the air injector nozzle (30) gets its actuation signal from a microswitch associated with each knifegate valve. When the switch contact is made via a striker pin, a spring closes the air control valve (35) between each cycle (load and discharge). This way the knifegate valves must be full open or closed before the air does its work either drawing vacuum or pressurizing the housing. When the compressed air is halted at the air cycling valve (32) and redirected via the upper chamber (28) back into pot (10) where the contents are expelled under pressure.

When the discharge timer attached to the inlet knifegate valve (17) times out, the signal to the control solenoid is halted and it returns to its default position. This in turn ports air to the open side of the inlet knifegate valve (17) and closed side of the outlet knifegate valve (22) relative to the pot (10). Air then passes through a load timer which actuates a timer solenoid and ports air to the air control valve (35). This allows flow through the air cycling valve (32) allowing the venturi effect to draw a vacuum on pot (10). Pot (11) is now in the discharge cycle. When the load timer times out the cycle is repeated until the air supply is terminated.

Apparatus in accordance with the foregoing embodiment allow an operator flexible control over both the throughput and the energy expended to transfer drill cuttings within a containment system as a variable drill program requires. This is accomplished by offering the operator individual pot control, with each pot capable of delivering up to 10,000+ litres per hour either wet or dry cuttings and requiring only 150 CFM of air, delivering a more manageable and energy efficient system. A performance benefit of this system is the increased in-line air flow generated by the twin pot function. In a normal dual venturi process, one system would inevitably slave to the other, the above embodiment's configuration avoids this and delivers greater in-line convey velocities.

It will of course be realised that while the above has been given by way of illustrative example of this invention, all such and other modifications and variations thereto as would be apparent to persons skilled in the art are deemed to fall within the broad scope and ambit of this invention as is set forth in the claims appended hereto.

The invention claimed is:

1. A pump apparatus including:

a first pumping element, the first pumping element comprising:

a first housing having a first material inlet, and a first discharge outlet to a first delivery line, a second pumping element, the second pumping element comprising:

a second housing having a second material inlet, a second discharge outlet to a second delivery line, a first venturi associated with the first housing;

a second venturi associated with the second housing:

a controller, the controller controlling actuators operating a first inlet valve on the first material inlet, a second inlet valve on the second material inlet, a first discharge valve on the first discharge outlet, a second discharge valve on the second discharge outlet, wherein the controller is configured to control the first inlet valve, the second inlet valve, the first discharge valve, and the second discharge valve such that:

when the first pumping element and the second pumping element are both in operation, the first pumping element and the second pumping element each alternate between a load phase and a discharge phase wherein alternation between the load phase and the discharge phase by the first pumping element and the second pumping element is out of phase, and when only one of the first pumping element or the second pumping element is in operation, only one of the first pumping element and the second pumping element will alternate between the load phase and the discharge phase; and a compressed air supply delivering cyclically to:

the first venturi to reduce the first housing pressure for charging and to the first housing for pressure discharge, the second venturi to reduce the second housing pressure for charging and to the second housing for pressure discharge.

2. A pump apparatus according to claim 1, further comprising:

a third pumping element, the third pumping element comprising:

a third housing having a third material inlet, and a third discharge outlet to the first delivery line, a fourth pumping element, the fourth pumping element comprising:

a fourth housing having a material inlet, a fourth discharge outlet to the second delivery line, wherein the third pumping element is configured to selectively deliver in phase with the first pumping element to the first delivery line and the fourth pumping element is configured to selectively deliver in phase with the second pumping element to the second delivery line.

3. A pump apparatus according to claim 1, wherein the first delivery line, the second delivery line, or both includes air injection means directing high pressure air into the delivery line to add impetus to the material in the line.

4. A pump apparatus according to claim 1, wherein the first material inlet and the second material inlet are manifolded together to draw from a common material supply.

5. A pump apparatus according to claim 4, wherein the manifold is in the form of a chamber that is in a substantially constant state of reduced pressure by virtue of out-of-phase operation of the first pumping element and the second pumping element.

6. A pump apparatus according to claim 4, wherein the manifold is associated with a storage means for accumulating product prior to pumping.

7. A pump apparatus according to claim 6, wherein the storage means is a hopper configured to provide some gravity-assist and to minimize the mean free path for air through the product.

8. A pump apparatus according to claim 1, wherein the first housing, the second housing, or both are configured such that the first material inlet and/or the second material inlet is in the top and the first discharge outlet, the second discharge outlet, or both are configured at the bottom to provide gravity assistance to charge and discharge.

9. A pump apparatus according to claim 8, wherein the lower end of the first housing, the second housing, or both includes an inverted cone with the first discharge outlet and/or the second discharge outlet at the apex to optimize gravity assistance in discharge through the outlet.

10. A pump apparatus according to claim 9, wherein the first housing, second housing, or both is a pressure vessel optimized for pressure keeping and has a portion internal to said inverted cone fitted for optimizing flow.

11. A pump apparatus according to claim 1, wherein the first and second material inlets and the first and second discharge outlets each comprise a knifegate-type valve.

12. A pump apparatus according to claim 1, wherein the first and second material inlets and the first and second discharge outlets each comprise pneumatic actuators.

13. A pump apparatus according to claim 1, wherein the first material inlet and the first discharge outlet, the second material inlet and the second discharge outlet, or both are operationally interconnected to effect the cyclic operation of the first pumping element, the second pumping element, or both.

14. A pump apparatus according to claim 13, wherein the operational interconnection is mechanically by means of a common double-action actuator.

15. A pump apparatus according to claim 1, wherein the first material inlet and the second material inlet, the first discharge outlet and the second discharge outlet, or both are operationally interconnected for alternate operation to effect a lock-stepping of out-of-phase operation of the respective pumping elements.

16. A pump apparatus according to claim 15, wherein the operational interconnection is mechanical by means of respective common double-action actuators.

17. A pump apparatus according to claim 1, wherein the first venturi forms part of a first ejector assembly including a first elongate body having a first low-restriction upper chamber narrowing to a first accelerator tube, the venturi effect being provided by a first injector nozzle directing high pressure air from an air supply across the first upper chamber into the first accelerator tube, lowering the pressure in the first upper chamber.

18. A pump apparatus according to claim 17, wherein the first upper chamber is in fluid communication with the top portion of the first housing to effect a reduction in pressure in the first housing.

19. A pump apparatus according to claim 17, wherein the air supply to the first injector nozzle is switched by an air control valve.

20. A pump apparatus according to claim 19, wherein the air control valve is open through both the charge and discharge parts of the cycle, and is closed to disable the first pumping element when the first pumping element is not in operation.

21. A pump apparatus according to claim 20, wherein the first ejector assembly includes a first cycling valve across the first accelerator tube or a venturi exhaust, the first cycling valve operable to alternately open the venturi exhaust to allow the first venturi to operate and reduce pressure in the first housing, and to close the venturi exhaust path to stall the venturi, close off the venturi exhaust path to the delivery line, and pressurize the first upper chamber and the first housing.

22. A pump apparatus according to claim 21, wherein limit switches associated with the first material inlet and/or the first discharge outlet are used to ensure that the first material inlet and/or the first discharge outlet are appropriately set before the controller operates the cycling valve.

23. A pump apparatus according to claim 1, wherein the controller comprises a pneumatic controller.

24. A pump apparatus according to claim 23, wherein the controller comprises a programmable logic controller (PLC).

25. A pump apparatus according to claim 23, wherein the controller controls directly or indirectly any one or more of the functions of charge volume control, discharge volume control, pumping element on/off control, air pressure regulation, inlet and outlet valve timing, venturi operation and housing pressurization control.

26. A pump apparatus according to claim 25, wherein the controller controls the amount of material admitted to the first housing, the second housing, or both for each cycle by including a timer function.

* * * * *